US005868590A

United States Patent [19]

Dobbelaere

[11] Patent Number: 5,868,590

[45] Date of Patent: Feb. 9, 1999

[54] CONTACT SPRING

[75] Inventor: Joris Dobbelaere, Beernem, Belgium

[73] Assignee: Siemens Aktiengesellschaft, Munich, Germany

[21] Appl. No.: 789,486

[22] Filed: Jan. 27, 1997

[30] Foreign Application Priority Data

Jan. 26, 1996 [DE] Germany ..... 196 02 822.1

[51] Int. Cl.[6] ..... H01R 4/48

[52] U.S. Cl. ..... 439/839

[58] Field of Search ..... 439/839, 842, 439/843, 846, 847, 849, 850, 744, 745, 891

[56] References Cited

U.S. PATENT DOCUMENTS

| | | | |
|---|---|---|---|
| 5,338,229 | 8/1994 | Egenolf | 439/839 |
| 5,664,972 | 9/1997 | Zinn et al. | 439/839 |

FOREIGN PATENT DOCUMENTS

| | | |
|---|---|---|
| 32 48 078 C2 | 3/1986 | Germany . |
| 91 06 775.8 | 8/1991 | Germany . |
| 92 02 365.7 | 7/1993 | Germany . |

*Primary Examiner*—Paula Bradley
*Assistant Examiner*—Yong Ki Kim
*Attorney, Agent, or Firm*—Herbert L. Lerner; Laurence A. Greenberg

[57] ABSTRACT

A contact spring for an electrical bush contact includes bottom and top springs. The bottom spring has a boxlike housing as a spring arm base with two wide sides, two narrow sides and two opposite ends. The bottom spring has a connection part integrally adjoining one of the ends of the spring arm base, at least two independent resilient contact tongues disposed on each of the wide sides of the bottom spring at the other of the ends of the spring arm base, the contact tongues being angled relative to one another for defining an insertion funnel and touching one another in a position of repose, and additional side tongues disposed on each of the narrow sides of the bottom spring. The top spring is form-lockingly held on the bottom spring and encloses and fits over the spring arm base and the contact tongues of the bottom spring boxlike on four sides. The top spring has wide and narrow sides, spring buckles disposed on the wide sides of the top spring for urging the contact tongues of the bottom spring toward one another and spring buckles disposed on the narrow sides of the top spring and associated with the side tongues.

13 Claims, 4 Drawing Sheets

16
12
21
VIa
VIb
22
24
29
26
23
40
20
VIIa
VIIb
42
44
45
43
46

CONTACT SPRING

BACKGROUND OF THE INVENTION

Field of the Invention

The invention relates to a contact spring for an electrical bush contact, having a bottom spring with a boxlike housing as a spring arm base, two wide sides and two narrow sides each, a connection part integrally adjoining the spring arm base on one end, and resilient contact tongues angled relative to one another, defining an insertion funnel and formed onto the two wide sides of the opposite end of the spring arm base, the tongues touch one another in the position of repose, and having a top spring form-lockingly held on the bottom spring, the top spring encloses the spring arm base of the bottom spring on four sides and urges the contact tongues of the bottom spring toward one another with spring buckles disposed on the wide sides. A form-locking connection is one which connects two elements together due to the shape of the elements themselves, as opposed to a force-locking connection, which locks the elements together by force external to the elements.

Such contact springs are known in the prior art. For instance, German Utility Model DE 92 02 365 U1 describes a contact spring which is preferentially used widely as a plug connector in automotive engineering. The top spring serves the purpose primarily of increasing the contact force of the contact spring and, by forming detent tongues, of enabling releasable locking of the contact spring to an insulating housing.

Another structure for mutual locking of the top spring to the bottom spring is known from German Patent DE 32 48 078 C2. The spring arm base of the bottom spring provided in that patent is boxlike in cross section and has integrally formed-on top parts bent over by 90° on upper edges of side walls. A boxlike top spring is fitted over the assembly and engages a recess in the top part of the bottom spring from behind through the use of a detent tongue.

In practically all of the contact assemblies with flat spring contacts, various problems arise. Along with the lack of the requisite contact security and a highly conductive electrical connection, problems can result from inadequate heat dissipation, excessive plugging forces and mechanical damage from inadequate protection of the contact assembly.

In order to eliminate those disadvantages, various options have been utilized, such as a floating spring construction or longer spring travel with longer spring legs, or increasing the contact normal force along with high plugging forces for inserting counterpart contacts, or using expensive materials with improved conductivity.

All of the contact structures with flat spring contacts known thus far offer only partial solutions for what are quite complex needs.

SUMMARY OF THE INVENTION

It is accordingly an object of the invention to provide a contact spring, which overcomes the hereinafore-mentioned disadvantages of the heretofore-known devices of this general type and which assures good contact security and at the same time good heat conduction while being constructed and produced as simply as possible.

With the foregoing and other objects in view there is provided, in accordance with the invention, a contact spring for an electrical bush contact, comprising a bottom spring having a boxlike housing as a spring arm base with two wide sides, two narrow sides and two opposite ends, a connection part integrally adjoining one of the ends of the spring arm base, at least two independent resilient contact tongues disposed on each of the wide sides of the bottom spring at the other of the ends of the spring arm base, the contact tongues being angled relative to one another for defining an insertion funnel and touching one another in a position of repose, and additional side tongues disposed on each of the narrow sides of the bottom spring; and a top spring form-lockingly held on the bottom spring, the top spring enclosing and fitting over the spring arm base and the contact tongues of the bottom spring boxlike on four sides, and the top spring having wide and narrow sides, spring buckles disposed on the wide sides of the top spring for urging the contact tongues of the bottom spring toward one another, and spring buckles disposed on the narrow sides of the top spring and associated with the additional side tongues.

This embodiment of the contact spring makes it possible to produce both the bottom spring and the top spring in a simple way as stamped and bent parts. Moreover, good, secure contacting by the contact tongues and good heat conduction are assured by the side tongues that are also provided. Despite the good contact security, high plugging forces upon insertion of the counterpart contact do not arise, which until now otherwise could easily cause damage to the plug contacts and/or the contact tongues.

The side tongues according to the invention offer particular advantages in terms of the current-dictated thermal strain on the contacts that occur when contact is made, because on one hand the contact surface area is not inconsiderably increased and on the other hand the local heating and therefore heat dissipation are more favorable in the invention.

In accordance with another feature of the invention, in order to keep the contacting forces low on one hand and to assure secure contacting on the other hand, one spring buckle of the top spring is associated with each of the contact tongues formed onto the spring arm base, on which buckle the associated contact tongue is supported, or by which the applicable contact tongue is urged in the closing direction.

In accordance with a further feature of the invention, in the position of repose, the spring buckles of the top spring rest on the contact tongues and on the side tongues and increase the contact force of the tongues when a counterpart contact is inserted. Care is taken in accordance with the invention to ensure that, in order to reliably prevent damage to the contact spring, the spring buckles remain virtually inside the inside space profile defined by the top spring, or in other words they do not protrude anywhere. This assures that the spring buckles will cooperate only with the contact tongues rather than with any other articles, which could cause malfunctions or damage.

It is thus assured in this way that the spring buckles which urge the contact tongues and the side tongues do not protrude beyond the box profile of the top spring, but instead remain inside the box serving as a guard for the bottom spring. This is attained in particular in such a way that the spring buckles are cut out or stamped out of the respective side wall of the top spring and bent inward toward the contact tongues.

In accordance with an added feature of the invention, the contact tongues are provided with longitudinal slits, in order to improve heat conduction on one hand and contacting on the other hand. In view of the improved heat conduction which is desired, the heat-dissipating surface area of the bottom spring is increased by the longitudinal slits. However, the longitudinal slits are also highly significant for secure contacting, since the contact is not made through a single contact tongue as in the prior art, but instead a plurality of contacting points is assured through the use of a plurality of independent contact tongues.

In the prior art, considerable contacting problems could arise if plug and counterpart contacts were possibly inserted in a bent or skewed manner into the plug bushing, since the intended total contact area between the flat spring contact and the counterpart contact could not be used as intended because of the skewed position. This is not the case with the flat spring contacts according to the invention, because now a plurality of mutually independent contact tongues are each involved in the contacting. In this way it is assured that an adequate contact transition cross section is always available, so that contact-dictated voltage drops and the attendant malfunctions are practically precluded.

In accordance with an additional feature of the invention, at least some of the contact tongues are provided with a longitudinal slit. This is done in view of the desired elasticity of the contact tongues on one hand and the sufficient heat dissipation on the other hand. As a result, in terms of its contact-making and heat-dissipation behavior, the contact tongue is given virtually the same properties as individual tongues, but on the other hand its production and assembly are comparatively simple, because in a preferred embodiment, the longitudinal slit has at most half the length of the contact tongue.

In accordance with yet another feature of the invention, each contact spring is produced and assembled, for instance, from two paired, opposed contact tongues, but because of the aforementioned longitudinal slits these contact tongues have the effect of a plurality of parallel contact tongues. It may be expedient that the various contact tongues disposed opposite one another form symmetrically constructed pairs of tongues.

In accordance with yet a further feature of the invention, there is provided a contact leg, which cooperates with the associated side tongue and which may be formed onto the outside, toward the side tongues, of one contact tongue of each pair of tongues. This formed-on protuberance, designated as a contact leg, serves primarily to guide the counterpart contacts, inserted into the contact spring, as they are being inserted into the contact spring of the invention, and to prevent them from catching on the side tongues and thus causing damage.

In accordance with yet an added feature of the invention, the top spring is anchored to the spring arm base of the bottom spring through the use of bending tabs. This assures the immovable position of the top spring, so that even if the counterpart contact is inserted with excessive plugging force, damage to the contact spring from loosening of the top spring from the bottom spring is precluded.

In accordance with yet an additional feature of the invention, the recesses and formed-on protuberances may be provided on the top spring, which cooperate form-lockingly with an insulating shoe, and secure this shoe in its position.

In accordance with again another feature of the invention, the bottom spring is formed of electrically highly conductive material, such as copper or a copper alloy.

In accordance with a concomitant feature of the invention, both the bottom spring and the top spring are provided as stamped and bent parts, and the top spring is constructed of spring-hard material, such as sheet steel or spring bronze.

Other features which are considered as characteristic for the invention are set forth in the appended claims.

Although the invention is illustrated and described herein as embodied in a contact spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
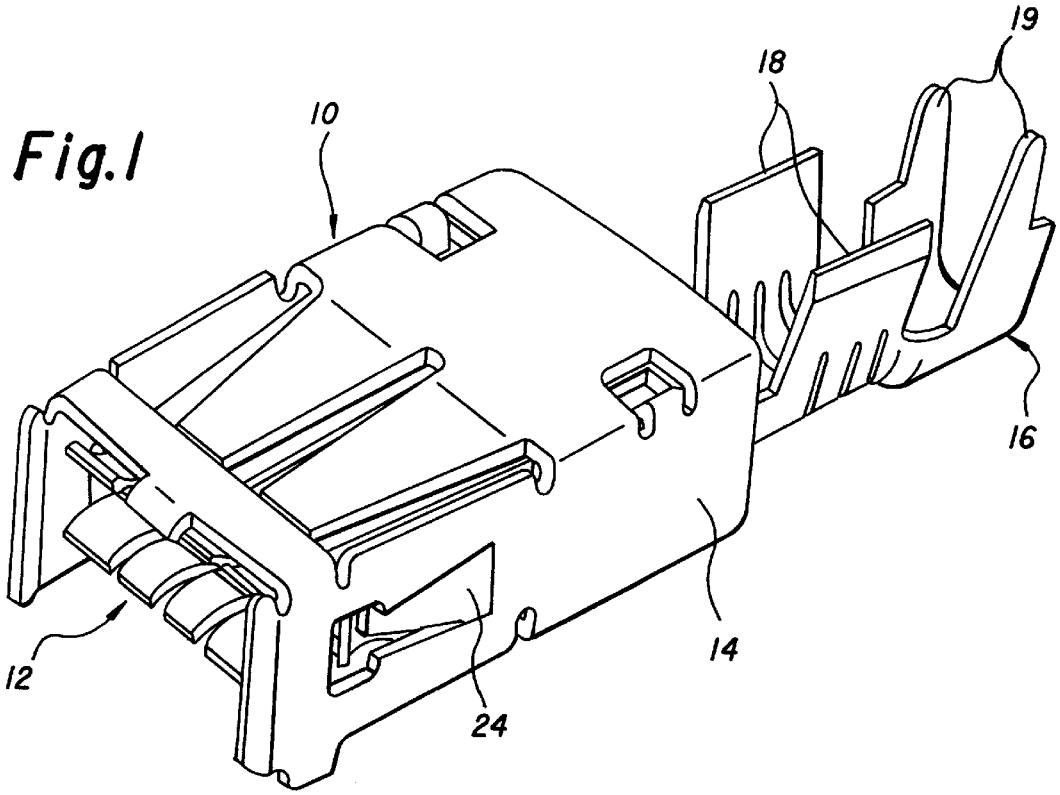
FIG. 1 is a diagrammatic, perspective view of a contact spring according to the invention, which is formed of a bottom spring and a top spring.

Referring now to the figures of the drawings in detail and first, particularly, to FIG. 1 thereof, there is seen a perspective oblique view of a contact spring 10 according to the invention, which is formed of a bottom spring 12 and a top spring 14.

The contact spring 10 shown in Fig, 1 has a connection part 16 adjoining the bottom spring 12, which is provided with bending tabs 18, 19 known as crimp connectors for connection of a non-illustrated cord. The bending tabs 18 serve to contact the insulated cord, and the bending tabs 19 serve to secure the insulated cord.

Figure 2:
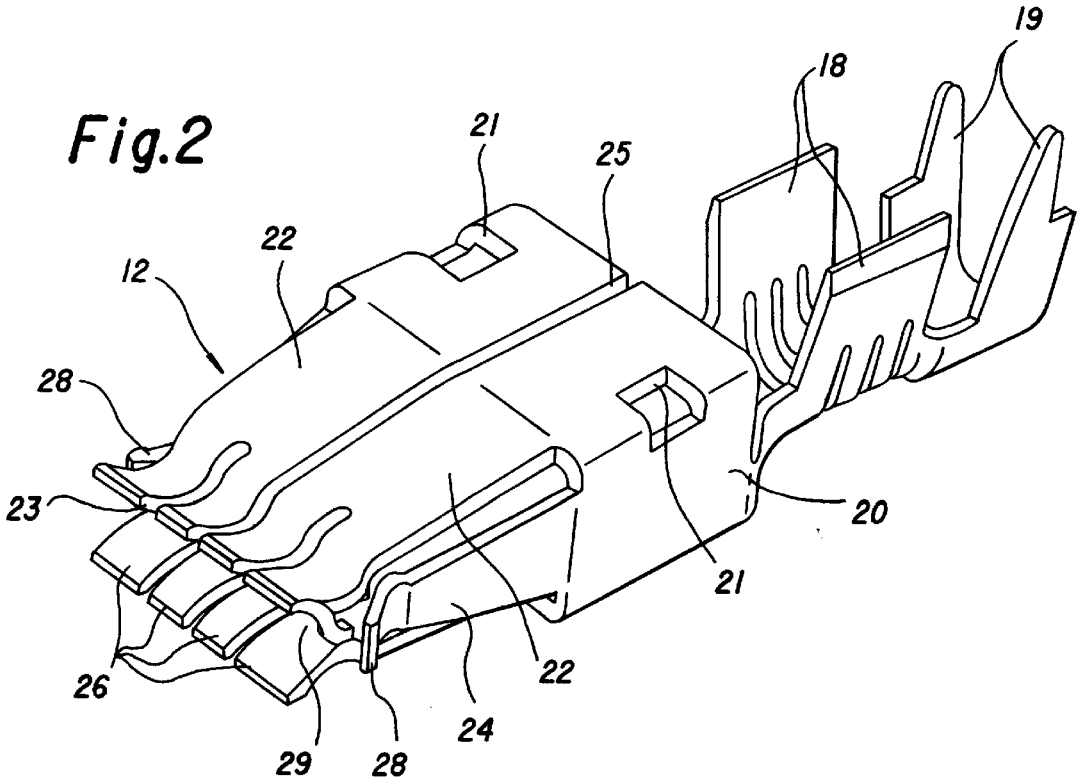
FIG. 2 is a perspective view of the bottom spring of FIG. 1.
Figure 3:
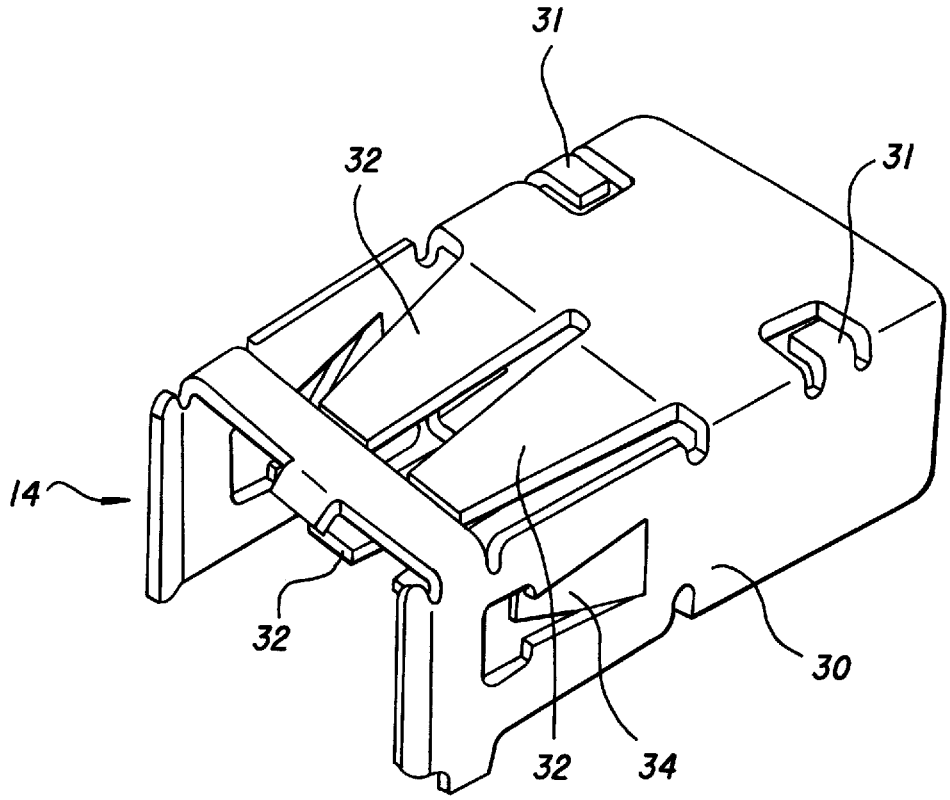
FIG. 3 is a perspective view of the top spring of FIG. 1.

The parallelepiped contact spring 10, which is shown as a complete component in FIG. 1, includes the bottom spring 12 shown in FIG. 2 and the top spring 14 shown in FIG. 3, which are illustrated herein as individual components, each in the form of a sheet-metal stamped and bent part.

The bottom spring 12 has a housing 20 which adjoins the above-mentioned connection part 16 and it has recesses 21 for a form-locking engagement of securing tabs 31 formed onto the top spring 14 of FIG. 3. In the example shown, two contact tongues 22 which face one another and are bent at angles from one another, and side tongues 24 on each side, are formed resiliently onto the housing 20. The contact tongues 22 in the example shown are each provided with one longitudinal slit 23 extending in the middle, so that the contact tongues 22 are as it were doubled in number, and the same is correspondingly then true of their then contacting. While in this case each of the contact tongues 22 is constructed as a double parallel tongue, the side tongues 24 have the shape of a wedge, or in other words they are constructed to be tapering conically toward a free end.

One wavy contact lip 26 is formed onto the free end of each of the contact tongues 22, or in other words at the front side of the contact spring 10. Together, these lips form a snoutlike insertion opening, which serves to make it easier to introduce a non-illustrated counterpart contact that is to be introduced into the contact spring 10. The wavy contact lips 26 come together and rest on one another at a certain distance from the front side. When the applicable counterpart contact is inserted, they are lifted away from one another by the counterpart contact and then rest on both sides against the counterpart contact.

The insertion should be possible with the least possible plugging force, yet without dropping below a minimum contact force. The minimum contact force serves to avoid unfavorable high transition resistances, which are caused by poor contacting and which can cause excessive heating of the contacts and therefore possible malfunctions.

The free ends of the side tongues 24 are also provided with wavy contact lips 28 in a manner similar to the contact tongues 22. However, while the contact lips 26 formed onto the contact tongues 22 rest on one another in the position of repose, this is not true for the contact lips 28 formed onto the side tongues 24. Instead, the contact lips 28 are merely close together on the outsides of the outer contact tongues 22 and thus provide lateral guidance for the counterpart contact.

In an advantageous feature, one contact leg 29 is formed on the outsides of each of the outer contact tongues 22. The contact leg 29 cooperates with the side tongues 24 and serves to steer the counterpart contact in front of the side tongues 24 without engaging it from behind, catching it and thus causing damage to the contact spring 10.

FIG. 3 shows the top spring 14 belonging to the contact spring 10. Like the bottom spring 12, it has a housing 30 of rectangular cross section, on which the securing tabs 31 are disposed in accordance with the location of the recesses 21 disposed in the housing 20 of the bottom spring 12. Once the bottom spring 12 and the top spring 14 have been put together to form the contact spring 10, these tabs 31 are bent in such a way that they engage the recesses 21.

Unlike the housing 20 of the bottom spring 12, the housing 30 of the top spring 14 is boxlike and has a length equivalent to the length of the housing 20 of the bottom spring 12, plus the length of the contact tongues 22. This structure serves to cover the bottom spring 12, including its contact tongues 22, at the side and on the top and bottom, and thus to protect it against damage from external factors.

The top spring 14 also has spring buckles 32, 34 which are produced by being stamped away from the housing 30 but are secured at one end. These buckles cooperate with the contact tongues 22 and the side tongues 24 of the bottom spring 12 and serve to brace the contact tongues and side tongues 22 and 24 and thus assure or even increase the requisite contact force of the contact tongues 22 in the operating state, or in other words once the counterpart contact has been inserted.

It can be seen from the bottom spring 12 shown in FIG. 2 that the housing 20 is bent from a stamped part. A parting line 25 results on the top of the housing 20 for production reasons. This parting line 25, which forms a narrow gap, is covered by the housing 30 of the top spring 14. The housing 30 is likewise produced as a bent part and has a corresponding non-illustrated parting gap on the underside which is not visible in the figure.

Figure 4B:
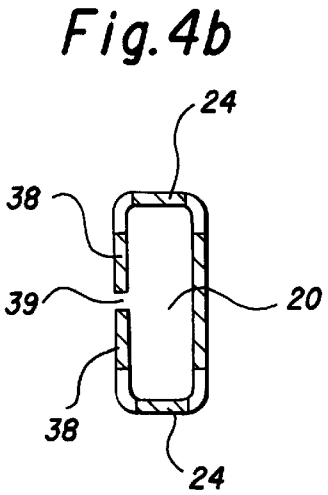
FIG. 4*b* is a cross-sectional view of the bottom spring of FIG. 4, which is taken along a section line IV*b*—IV*b* thereof, in the direction of the arrows.
Figure 4:
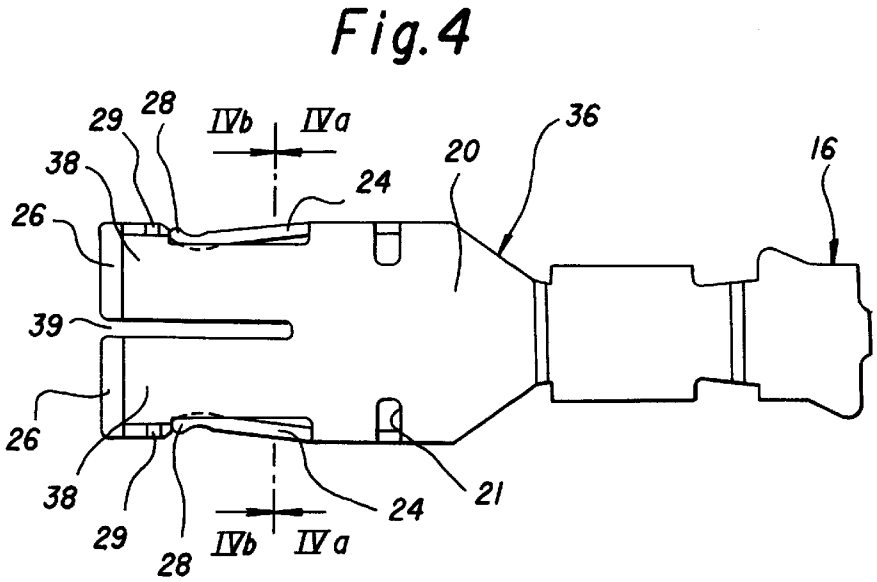
FIG. 4 is a plan view of a first variant of a bottom spring.

FIG. 4 is a plan view that shows a variant 36 of a bottom spring, which differs from the bottom spring 12 shown in FIG. 2 in that it has a different construction of its contact tongues 38, which are each constructed as single tongues in the embodiment of FIG. 4.

Figure 4A:
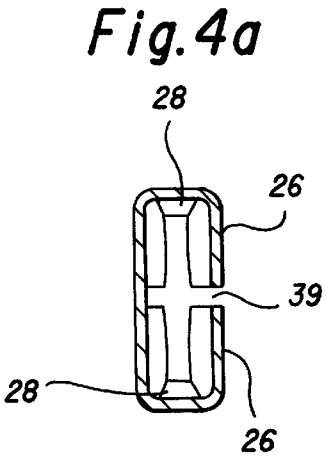
FIG. 4*a* is a cross-sectional view of the bottom spring of FIG. 4, which is taken along a section line IV*a*—IV*a* thereof, in the direction of the arrows.

FIG. 4*a* is a cross-sectional view of this variant of the bottom spring 36, which is taken along a section line IV*a*—IV*a*. The contact lips 26, 28 which were already mentioned above can be seen therein.

FIG. 4*b* is a further cross-sectional view through the bottom spring 36, which is taken along the section line IV*b*—IV*b*. In this view the rectangular shape of the housing of this bottom spring 36 is particularly visible.

Figure 5B:
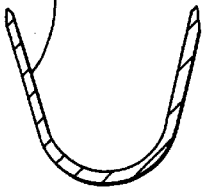
FIG. 5*b* is a cross-sectional view of the bottom spring of FIG. 4, which is taken along a section line V—V thereof, in the direction of the arrows.
Figure 5:
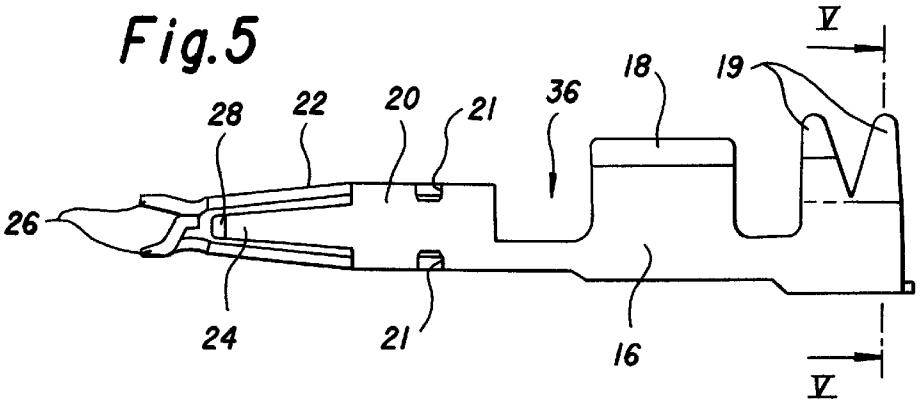
FIG. 5 is a side-elevational view of the bottom spring of FIG. 4.

FIG. 5 is a side view of the bottom spring 36 shown in FIG. 4, with the connection part 16 and the tabs 18, 19 belonging to the crimp connection. FIG. 5 also shows the associated housing 20 with the recesses 21 for securing the non-illustrated top spring 14, the contact tongues 22 with the contact lips 26 and the contact leg 29, as well as the side tongues 24 having the contact lips 28.

FIG. 5*b* is a cross-sectional view through the connection part 16, that is taken along the section line V—V and shows the different embodiment of the retaining tabs 19.

Figures 6, 6A, 6B, 7, 7A, 7B:
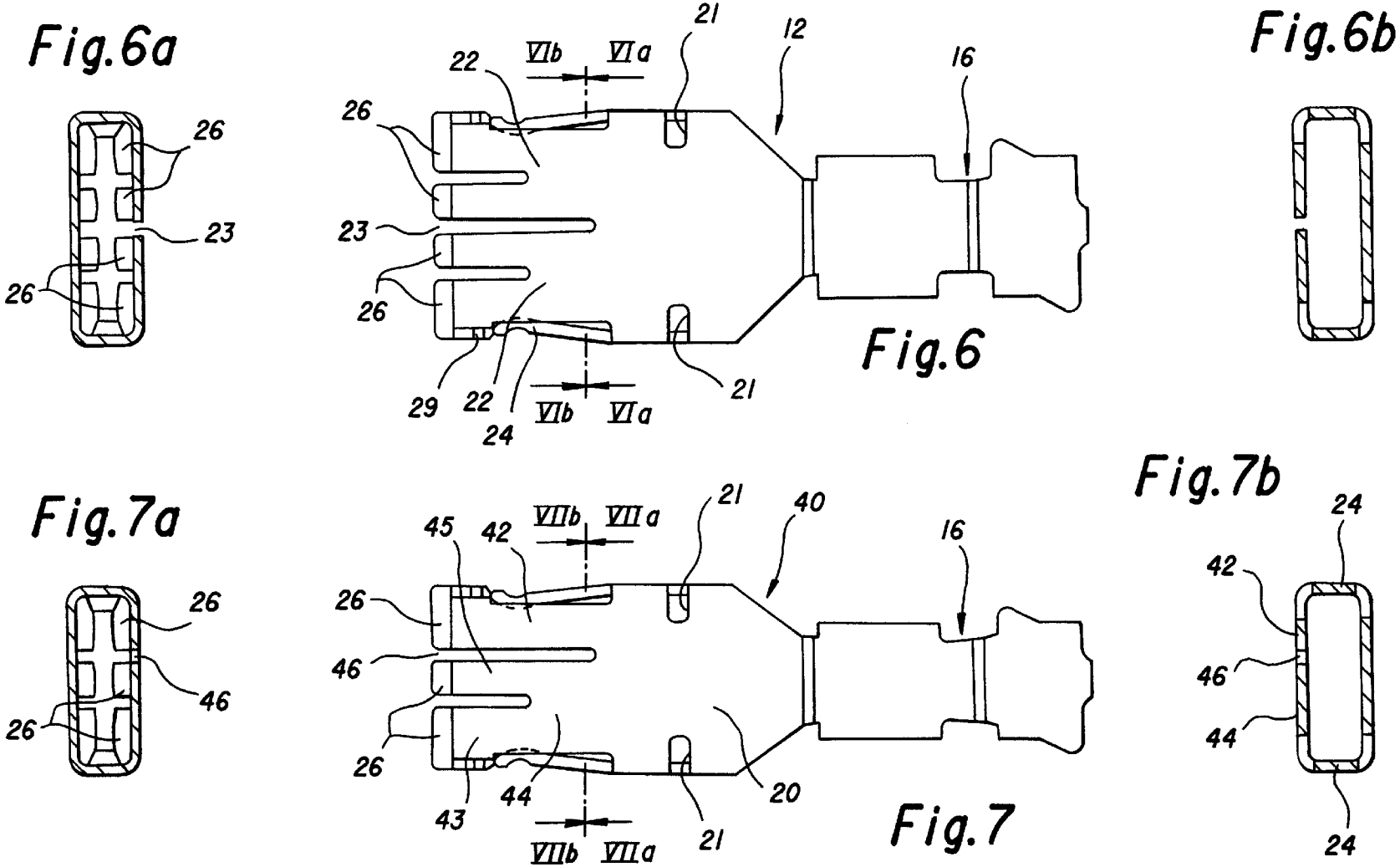
FIG. 6 is a plan view of a second variant of a bottom spring.
FIG. 6*a* is a cross-sectional view of the bottom spring of FIG. 6, which is taken along a section line VI*a*—VI*a* thereof, in the direction of the arrows.
FIG. 6*b* is a cross-sectional view of the bottom spring of FIG. 6, which is taken along a section line VI*b*—VI*b* thereof, in the direction of the arrows.
FIG. 7 is a plan view of a third variant of a bottom spring.
FIG. 7*a* is a cross-sectional view of the bottom spring of FIG. 7, which is taken along a section line VII*a*—VII*a* thereof, in the direction of the arrows.
FIG. 7*b* is a cross-sectional view of the bottom spring of FIG. 7, which is taken along a section line VII*b*—VII*b* thereof, in the direction of the arrows.

FIG. 6 is a plan view showing the variant of a bottom spring 12 which is known from FIG. 2 and which is equivalent to the bottom spring 12 shown in FIG. 2.

FIG. 6*a* is a cross-sectional view of this variant of the bottom spring 36, which is taken along the section line VI*a*—VI*a*. The contact lips 26, 28 that were already mentioned above can be seen therein.

FIG. 6*b* is a further cross-sectional view through the bottom spring 36, which is taken along the section line VI*b*—VI*b*. In this view, the rectangular shape of the housing of this bottom spring 36 is particularly visible.

FIG. 7 shows a third variant 40 of a bottom spring, which differs from the bottom spring 12 shown in FIG. 2 in terms of the structure of its contact tongues 42, 44, that are distributed asymmetrically in this case. This embodiment has the provision of one contact tongue 42 of normal width and one super-wide contact tongue 44. The super-wide contact tongue 44 has a longitudinal slit 46, which divides the contact tongue 44 into one normal-width contact tongue 43 and one narrow contact tongue 45. The narrow contact tongue 45 is disposed in the middle.

FIG. 7*a* is a cross-sectional view of this variant of the bottom spring 36, which is taken along the section line VII*a*—VII*a*. The contact lips 26, 28 that were already mentioned above can be seen therein.

FIG. 7*b* is a further cross-sectional view through the bottom spring 36, which is taken along the section line VII*b*—VII*b*. In this view the rectangular shape of the housing of this bottom spring 40 is particularly visible.

I claim:

1. A contact spring for an electrical bush contact, comprising:

a bottom spring having:

a boxlike housing as a spring arm base with two wide sides, two narrow sides and two opposite ends, a connection part integrally adjoining one of said ends of said spring arm base, at least one side tongue disposed on each of said narrow sides of said bottom spring; and at least two independent resilient contact tongues disposed on each of said wide sides of said bottom spring at the other of said ends of said spring arm base, said contact tongues being angled relative to one another for defining an insertion funnel and touching one another in a position of repose, one of said contact tongues having an outside surface, said one contact tongue having a contact leg formed on said outside surface toward an associated side tongue for cooperating with said associated side tongue, and a top spring form-lockingly held on said bottom spring, said top spring enclosing and fitting over said spring arm base and said contact tongues of said bottom spring boxlike on four sides, and said top spring having:

wide and narrow sides, spring buckles disposed on said wide sides of said top spring for urging said contact tongues of said bottom spring toward one another, and spring buckles disposed on said narrow sides of said top spring and associated with said side tongues.

2. The contact spring according to claim 1, wherein each of said spring buckles disposed on said wide sides of said top spring is associated with a respective one of said contact tongues on said spring arm base.

3. The contact spring according to claim 1, wherein said spring buckles disposed on said narrow sides of said top spring urge said contact tongues and said side tongues and do not protrude beyond a box profile of said top spring.

4. The contact spring according to claim 1, wherein at least some of said contact tongues have a longitudinal slit formed therein.

5. The contact spring according to claim 4, wherein said longitudinal slits extend over at most half of the length of said contact tongues.

6. The contact spring according to claim 1, wherein said contact tongues disposed opposite one another form symmetrically constructed pairs of tongues.

7. The contact spring according to claim 1, wherein said spring buckles of said top spring rest on said contact tongues and on said side tongues in the position of repose and increase a contact force of said tongues when a counterpart contact is inserted.

8. The contact spring according to claim 1, wherein said top spring has bending tabs engaging in recesses formed in said spring arm base of said bottom spring, for anchoring said top spring to said spring arm base of said bottom spring.

9. The contact spring according to claim 1, wherein said bottom spring is formed of highly electrically conductive material.

10. The contact spring according to claim 9, wherein said bottom spring is formed of a material selected from the group consisting of copper and a copper alloy.

11. The contact spring according to claim 1, wherein said top spring is a stamped and bent part of spring-hard material.

12. The contact spring according to claim 10, wherein said top spring is a stamped and bent part of spring bronze.

13. The contact spring according to claim 10, wherein said top spring is a stamped and bent part of sheet steel.

* * * * *